US012497799B2

(12) United States Patent
Dong et al.

(10) Patent No.: US 12,497,799 B2
(45) Date of Patent: Dec. 16, 2025

(54) MULTI-FORM TENT

(71) Applicant: HANGZHOU YIXIANG TECHNOLOGY RESEARCH AND DEVELOPMENT CO., LTD., Hangzhou (CN)

(72) Inventors: Baichen Dong, Hangzhou (CN); Yulin Ye, Hangzhou (CN); Jianing Zhu, Hangzhou (CN); Chao Gu, Hangzhou (CN); Bailin Xu, Hangzhou (CN)

(73) Assignee: HANGZHOU YIXIANG TECHNOLOGY RESEARCH AND DEVELOPMENT CO., LTD., Hangzhou (CN)

( * ) Notice: Subject to any disclaimer, the term of this patent is extended or adjusted under 35 U.S.C. 154(b) by 242 days.

(21) Appl. No.: 18/452,522

(22) Filed: Aug. 19, 2023

(65) Prior Publication Data

US 2024/0200356 A1 Jun. 20, 2024

(30) Foreign Application Priority Data

Dec. 20, 2022 (CN) ..... 202223452621.2
Jan. 3, 2023 (CN) ..... 202320048147.2

(51) Int. Cl.

*E04H 15/54* (2006.01)
*E04H 15/56* (2006.01)
*E04H 15/64* (2006.01)
*E04H 15/16* (2006.01)

(52) U.S. Cl.

CPC ..... *E04H 15/54* (2013.01); *E04H 15/56* (2013.01); *E04H 15/64* (2013.01); *E04H 15/16* (2013.01)

(58) Field of Classification Search

None

See application file for complete search history.

(56) References Cited

U.S. PATENT DOCUMENTS 3,670,747 A * 6/1972 Pohl ..... E04H 15/00 135/156
5,067,505 A * 11/1991 Cantwell ..... E04H 15/40 135/125
5,421,355 A * 6/1995 Cantwell ..... E04H 15/425 135/120.3
7,578,306 B2 * 8/2009 Mettavant ..... E04H 15/16 135/156

(Continued)

*Primary Examiner* — David R Dunn
*Assistant Examiner* — Danielle Jackson
(74) *Attorney, Agent, or Firm* — HOWARD M COHN and Associates, LLC

(57) ABSTRACT

A multi-form tent comprises a main body and a base, the main body being installed on the base, the outer tent being at least partly located above the inner tent, the inner tent supporting the middle of the outer tent, the inner tent and the outer tent being detachably connected, wherein there are at least two forms of mutual connection between the outer tent and the inner tent. The multi-form tent can expand users' range of activities in an unfolded state of a single outer tent, where users' activities are allowed not only in the inner tent, but also under the cover of the outer tent. The tent has various forms, which can realize the linkage between multiple tents, improving interactive properties. Also, the tent in a wrapping state can also realize such effect as thermal insulation, windproof, rainproof, etc.

7 Claims, 15 Drawing Sheets

(56) References Cited

U.S. PATENT DOCUMENTS

| | | | | |
|---|---|---|---|---|
| 8,763,621 | B2 * | 7/2014 | Jin | E04H 15/42 135/156 |
| 8,869,814 | B2 * | 10/2014 | Jin | E04H 15/34 135/94 |
| 9,243,421 | B2 * | 1/2016 | Jin | E04H 15/16 |
| 9,771,729 | B2 * | 9/2017 | Workman | E04H 1/005 |
| 10,450,772 | B2 * | 10/2019 | LaHood | E04H 15/56 |
| 11,761,229 | B1 * | 9/2023 | Hale | E04H 15/54 135/115 |
| D1,047,063 | S * | 10/2024 | Mundy | D21/834 |
| 2004/0238021 | A1 * | 12/2004 | Holub | E04H 15/30 135/97 |
| 2022/0389735 | A1 * | 12/2022 | Liu | E04H 15/64 |

* cited by examiner

B

C

D

E

J

K

MULTI-FORM TENT

REFERENCE TO RELATED APPLICATIONS

The present application claims the priorities of Chinese patent application No. 202223452621.2, filed on Dec. 20, 2022, and Chinese patent application No. 202320048147.2 filed on Jan. 3. 2023, the entire discloses of which are incorporated herein by reference.

FIELD OF THE DISCLOSURE

The present disclosure relates to a tent, in particular, to a multi-form tent.

BACKGROUND OF THE DISCLOSURE

Tent is a kind of camping and living prefabricated house that is easy to assemble and dismantle, and commonly used in various outdoor activities. At present, some tents are designed with a top made of a gauze or a transparent state in order to ensure effective ventilation inside, but it is subject to invasion of dew into the tent in the middle of the night. Therefore, it is necessary to provide an outer tent on the top of the tent to cover the net or through holes on the top of the tent. However, the connection form between outer tent and inner tent of the existing tents is too single to meet diverse demands of users.

SUMMARY OF THE DISCLOSURE

I. Technical Problem to be Solved

With respect to the deficiencies of the prior art, the present disclosure provides a multi-form tent, which solves the problems raised in the Section "Background Art."

II. Technical Solutions

In order to achieve the above object, the present disclosure is carried out through the following technical solutions: a multi-form tent, including a main body and a base, the main body being installed on the base, the main body including an inner tent and an outer tent, the outer tent being at least partly located above the inner tent, the inner tent supporting a middle part of the outer tent, the inner tent and the outer tent being detachably connected, and there are at least two forms of mutual connection between the outer tent and the inner tent.

Preferably, the inner tent includes a side wall and a top wall, a joint of the side wall and the top wall is connected with the outer tent, the top wall is entirely located under the outer tent, and projection of the inner tent on the outer tent is entirely located inside the outer tent.

Preferably, the side wall includes a window side wall and a door wall, and height of an edge of the outer tent located in front of the window side wall is lower than height of an edge of the outer tent located in front of the door wall.

Preferably, there are at least two tents, and outer tents of two tents adjacent are detachably connected.

Preferably, the adjacent outer tents are connected by one of buckles, magnetic attractor, snap fasteners or hook-and-loop fasteners.

Preferably, the outer tent has a wrapping state, where the outer tent completely wraps the top wall and at least partially wraps the side wall, the outer tent includes an opening, the side wall includes a door wall, and the opening of the outer tent is arranged opposite to the door wall.

Preferably, the base includes a base body and a sealing part, the sealing part is fixedly connected to the base body, a connecting part is provided at the bottom of the inner tent, the connecting part is detachably connected to the sealing part, and the connecting part and the sealing part are located above the base body.

Preferably, the connecting part and the sealing part are connected by a hook-and-loop fastener, snap fasteners, buttons, buckles, magnetic attractor or zippers.

Preferably, both the connecting part and the sealing part are provided with a sticking area, the sticking area of the connecting part is highly consistent with the sticking area of the sealing part, and the sticking area of the sealing part is located at an upper end of the sealing part, and the base body includes a positioning part located inside the sealing part, the positioning part and the sealing part being located inside the connecting part.

Preferably, the base further includes a first side and a second side, the door wall corresponds to the first side, the side wall corresponds to the second side, and a second fixing piece is provided on the side wall, a first fixing piece is provided on the second side, the second fixing piece being arranged vertically opposite to the first fixing piece.

III. Advantageous Effect

The present disclosure provides a multi-form tent, bringing about the following advantageous effects:

The multi-form tent can expand users' range of activities with a single outer tent, so that users could not only stir in the inner tent, but also under the cover of the outer tent; the tent has a variety of forms, which can realize linkage of multiple tents to improve interactive properties and can also use the wrapping state to keep warm, windproof and rainproof of the tent.

Figure 1:
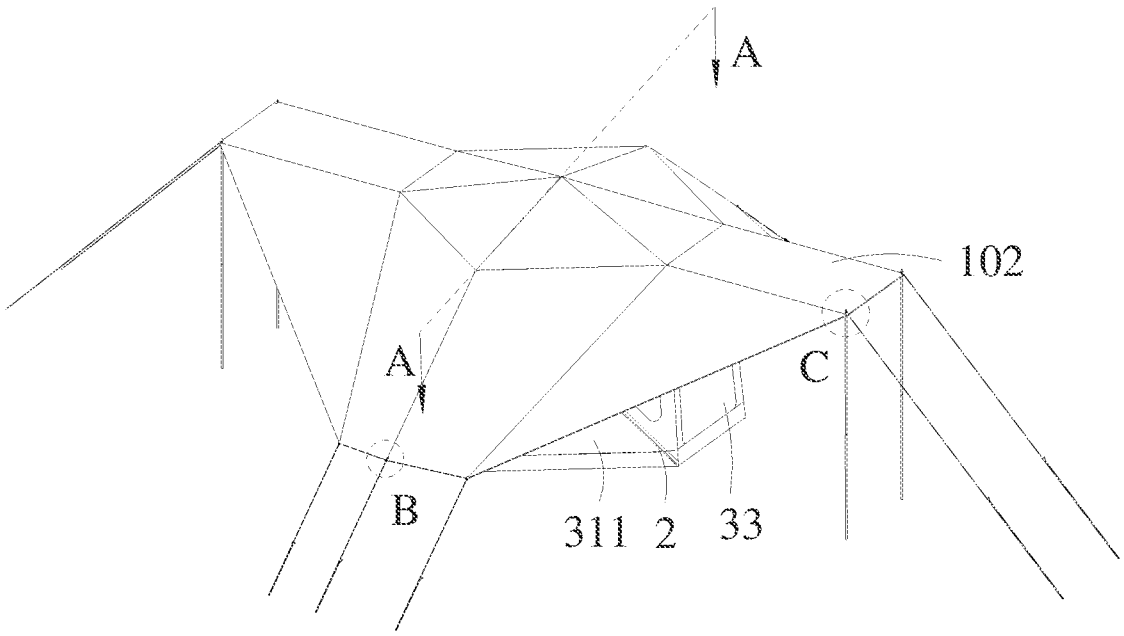
FIG. 1 is a three-dimensional assembly schematic diagram of an outer tent of the tent according to an embodiment of the present disclosure.

In the drawings: 1—main body; 101—inner tent; 102—outer tent; 11—connecting part; 2—frame; 21—hub; 22—support member; 23—strut member; 3—wall; 31—side wall; 311—window side wall; 312—curtain; 32—top wall; 33—door wall; 35—metal ring; 36—second fixing piece; 81—outer tent strut; 82—gate rod; 821—door protrusion; 83—wind rope; 831—anti—slip sheet; 832—nylon rope; 84—button; 841—button ring; 842—sticking area; 85—cloth fixing ring; 86—installation bag; 1021—outer tent opening; 4—base; 47—base body; 471—first inflation port; 472—first side; 473—second side; 474—handle part; 475—first fixing piece; 48—sealing part; 49—positioning part; 491—second inflation port.

DETAILED DESCRIPTION OF THE EMBODIMENT(S) OF THE DISCLOSURE

Embodiments of the present disclosure provides a multi-form tent. As shown in FIGS. 1-33, the tent includes a main body 1 and a base 4, and the main body 1 is installed on the base 4. The bottom of the main body 1 can wrap the base 4, that is, the area of the horizontal cross-section at the joint of the bottom of the main body 1 and the base 4 is greater than the area of the horizontal cross-section of the upper surface of the base 4, and the base 4 is located inside the main body 1. When it rains, rainwater can flow down along the surface of the main body 1 to facilitate water flowing out and reduce accumulation of rainwater on the base 4. It can be understood that the main body 1 can also be entirely located above the base 4, or at the joint between the main body 1 and the base 4, most of which are located above the base 4. That is, the area of the horizontal cross-section of the joint between the bottom of the main body 1 and the base 4 is smaller than the area of the horizontal cross-section of the upper surface of the base 4, and the bottom of the main body 1 is connected to the upper or inner surface of the base 4, which improves connection convenience of the base 4 of the main body 1.

The main body 1 includes an inner tent 101 and an outer tent 102, the inner tent 101 includes a frame 2 and a wall 3, and the wall 3 is fixedly connected with the frame 2, that is, the frame 2 supports the wall 3. It can be understood that the frame 2 and the wall 3 can be fixed in a detachable way. For example, the frame 2 is detachably connected to those on the wall 3 such as sleeve, adhesive parts, magnetic parts, clamping parts, etc., and the connection can also be achieved by the frame 2 clamping the wall 3. Other fixing methods can also be used, such as mutual sewing of the frame 2 and the wall 3, stitching of the frame 2 into the wall 3, or fixing of the frame 2 and the wall 3 through connectors. Of course, it is also possible to detachably connect part of the frame 2 to the wall 3, and fixedly connect part of the frame 2 to the wall 3. The wall 3 can be made of soft materials, such as cloth, knitted, mesh-like or rubber materials, and can also be made of hard materials, such as plastics, wood boards, etc. Of course, some materials could be hard supports, and some could be soft materials, thereby improving support strength of the entire tent.

Figure 2:
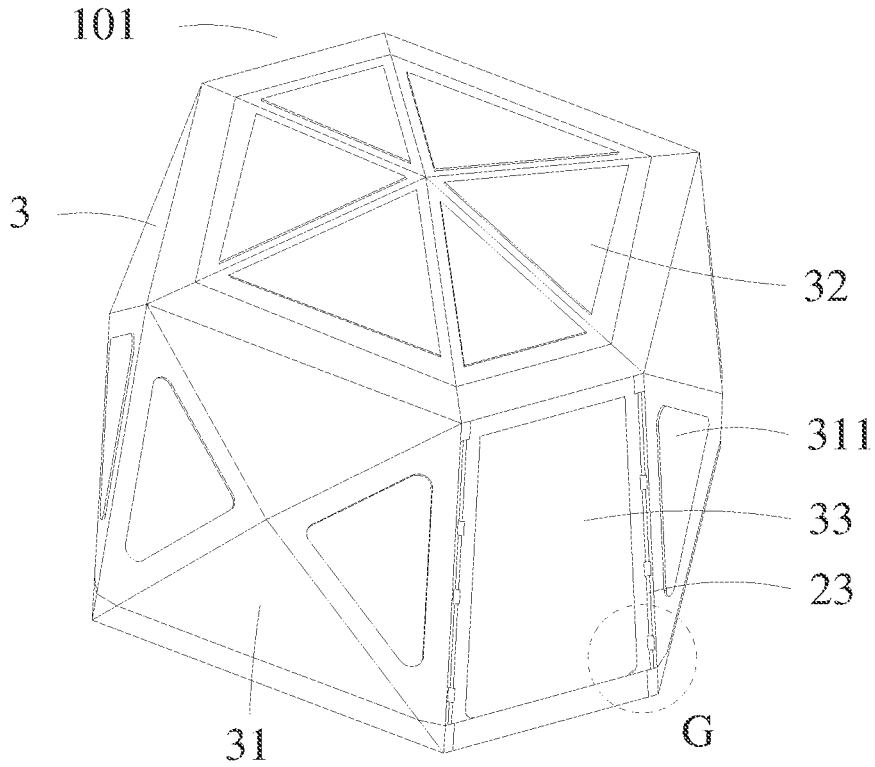
FIG. 2 is a three-dimensional schematic diagram of an inner tent according to an embodiment of the present disclosure.

Further referring to FIGS. 1 and 2, the wall 3 can be composed of a whole piece of cloth. Under support of the frame 2, the wall 3 at least has a side wall 31 and a top wall 32. There is a plurality of side walls 31, for example, four side walls 31, six side walls 31, eight side walls 31, or more side walls 31, to form a tent. The tent in this embodiment is approximately hexagonal, with advantages of large space and stable structure under the same space size. The side wall 31 includes a window side wall 311 and a door wall 33, and there may be only one door wall 33, or multiple, such as 2, 4, and so on. The door wall 33 can be provided separately, for example, one of the side walls 31 is used as the door wall 33, and the door wall 33 is fixedly or detachably connected to other adjacent side walls 31. In this embodiment, there are two door walls 33, and the two door walls 33 are arranged oppositely. The opposite door walls 33 make the ventilation effect of the whole tent better. The door wall can also be formed on the side wall 31 directly. For example, a large opening, vertical, triangular or oval, etc., could be formed on the side wall 31. Different setting methods can be selected upon demand of users. Each side wall 31 can be a planar structure from the top wall 32 to the direction of the base 4, such as a vertical plane, or an oblique plane; it can also be a concave-convex structure, such as concave-convex with a curved surface, or concave-convex with a central circle, or Pyramid concave-convex. Each side wall 31 may be formed as an integral side wall 31 or an integral part of the entire wall 3; and windows or openings may also be provided. The top wall 32 is formed integrally or is an integral part of the entire wall 3 and is supported by the frame 2.

Specifically, there are six sidewalls 32, and the six sidewalls 31 have four window sidewalls 311 and two door walls 33, and the window sidewalls 311 is provided with windows, on which a gauze is arranged, and which could be opened using zippers, hook-and-loop fasteners or snap fasteners provided thereat. The two opposite door walls 33 are axes, two window side walls 311 are located on one side of one of the door walls 33, and the other two window side walls 311 are located on the other side of the door wall 33.

Figure 3:
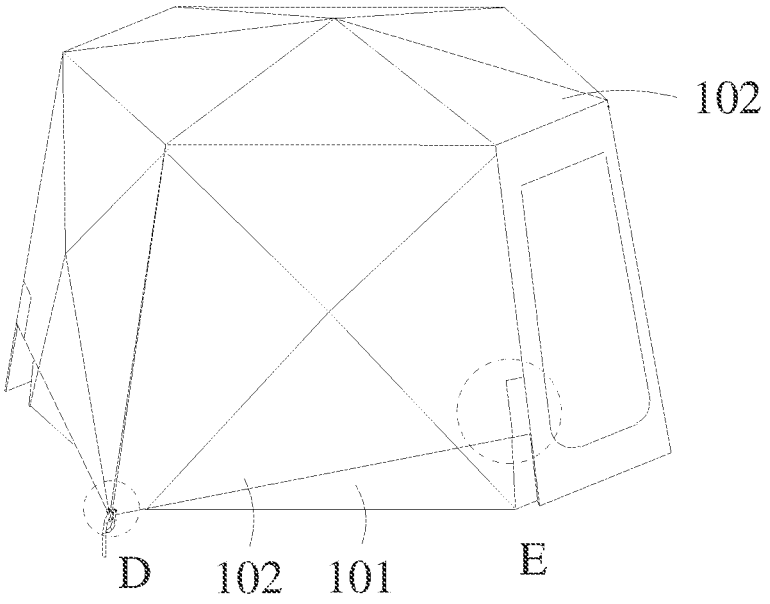
FIG. 3 is a three-dimensional assembly schematic diagram of the outer tent wrapping of the tent according to an embodiment of the present disclosure.
Figure 15:
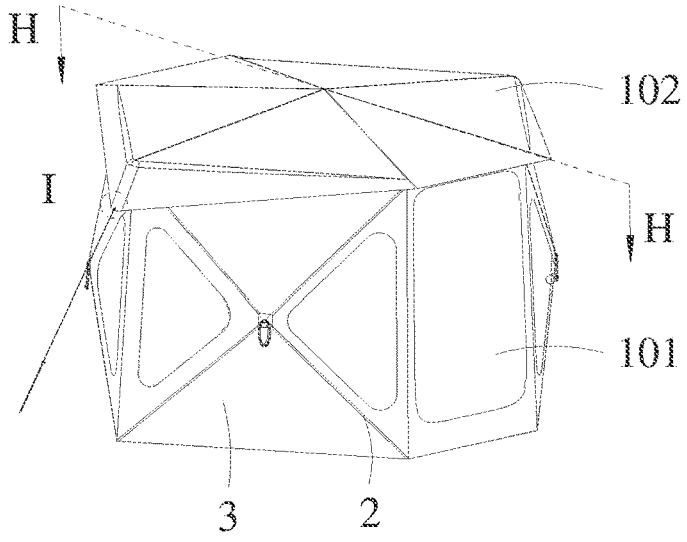
FIG. 15 is a schematic perspective view of assembly of the outer tent and the inner tent according to another embodiment of the present disclosure.

Further referring to FIG. 1, FIG. 3 and FIG. 15, the inner tent 101 and the outer tent 102 are detachably connected. When the inner tent 101 and the outer tent 102 are connected, a middle part of the outer tent 102 is at least partly located above the inner tent 101. The outer tent 102 can be directly attached to the inner tent 101, so that the outer tent 102 and the top wall 32 of the inner tent 101 are close to each other, or the middle part of the outer tent 102 can keep a certain distance from the top wall 32 of the inner tent 101, or the middle part of the outer tent 102 could be in close contact with or fixed in contact with the top wall 32, and part of the outer tent 102 is kept at a certain distance from the top wall 32.

When the outer tent 102 and the top wall 32 of the inner tent 101 are in close contact with each other, the hook-and-loop fastener can be used. Specifically, a male sticker of the hook-and-loop fastener is provided on either of a side of the outer tent 102 close to the top wall 32 and a side of the top wall 31 close to the outer tent 102, and a female sticker of the hook-and-loop fastener is provided on the other side, so that the outer tent 102 and the top wall 32 are detachably connected via the hook-and-loop fastener. The hook-and-loop fastener can be set in a circumferential direction of the top wall 32, also can be set in a radial direction of the top wall 32. Certainly, part of the hook-and-loop fastener can be set in the circumferential direction, and part set in the radial direction. If the hook-and-loop fastener is arranged at the joint of the door wall 33 and the top wall 32, it will facilitate users determining position of the hook-and-loop fastener and facilitate installation and positioning of the outer tent 102.

Figure 19:
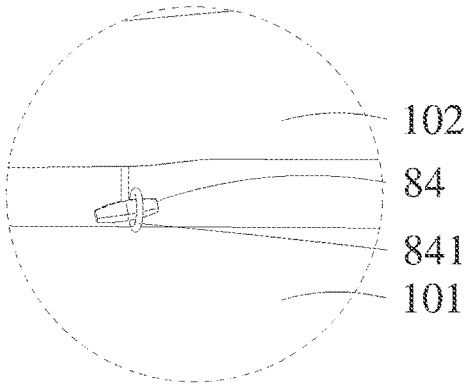
FIG. 19 is an enlarged schematic diagram of circle K in FIG. 16.
Figure 20:
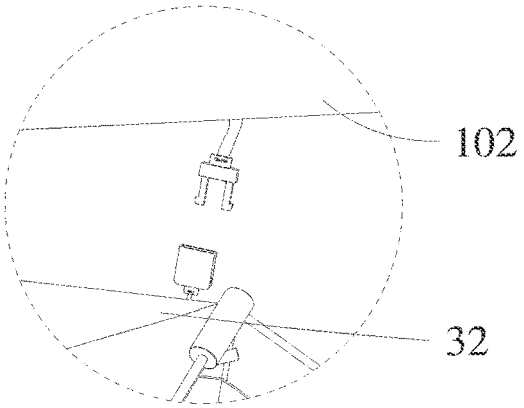
FIG. 20 is a schematic diagram of the connection between the outer tent and the inner tent according to an embodiment of the present disclosure.

Further referring to FIG. 19 and FIG. 20, it can be understood that male and female buckles, or magnetic attractor, snap fasteners or the like can also be used as long as the outer tent 102 and the inner tent 101 can be detached. For example, one of the outer tent 102 and the inner tent 101 is provided with a male buckle, the other is provided with a female buckle, and the outer tent 102 and the inner tent 101 are connected by the buckles. The buckles can be directly connected with the outer tent 102, and the buckles can also be connected through a certain length of cord, a cloth bag or other connection methods so that there is a certain activity space between the buckles and the outer tent 102. Similarly, there is also a certain activity space between the buckle and the inner tent 101. That is, when the inner tent 101 and the outer tent 102 are installed, there is no need to intentionally align the position completely. Leaving a certain amount of activity margin is convenient for users to make installation and improves the user experience.

Figure 22:
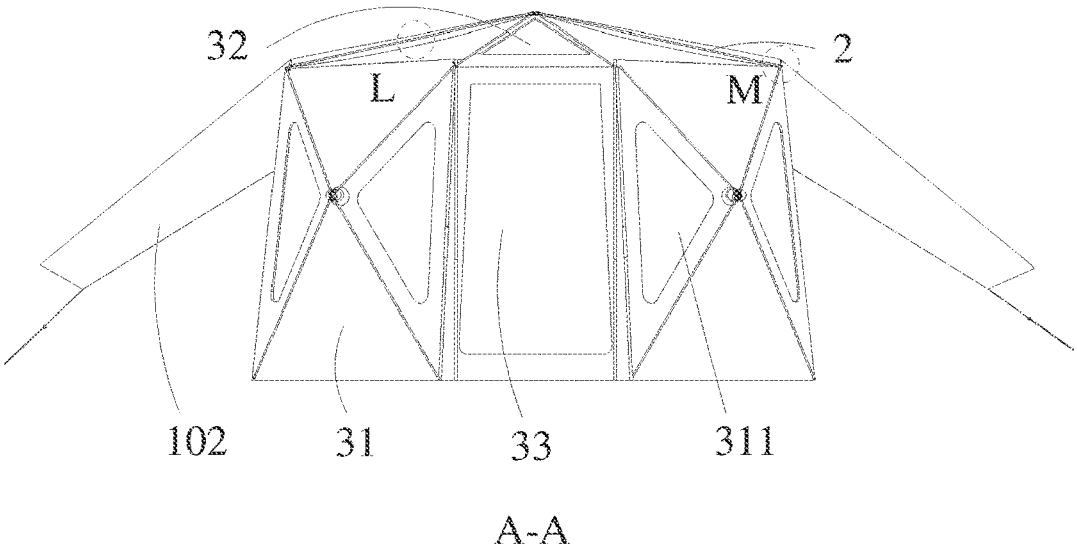
FIG. 22 is a schematic sectional view along line A-A in FIG. 1.
Figure 23:
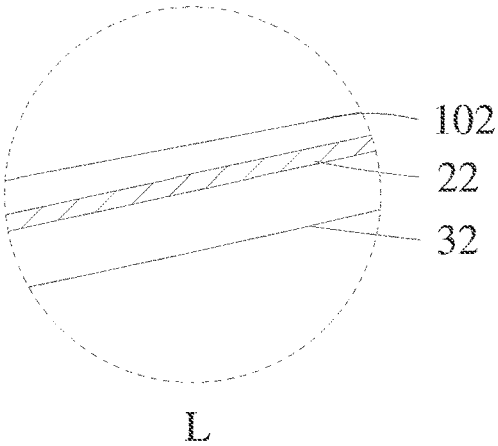
FIG. 23 is an enlarged schematic diagram of circle L in FIG. 22.
Figure 24:
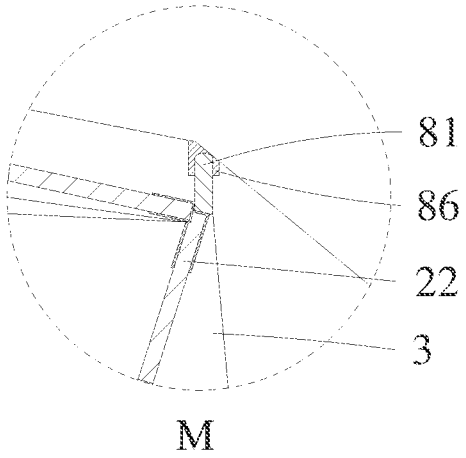
FIG. 24 is an enlarged schematic diagram of circle M in FIG. 22.

Further referring to FIG. 22, FIG. 23 and FIG. 24, when there is at least a partial distance between the outer tent 102 and the top wall 32 of the inner tent 101, the tent is also provided with outer tent struts 81, which are partially or entirely located between the outer tent 102 and the inner tent 101. The outer tent struts 81 are used to support the outer tent 102 to at least partially keep a distance between the outer tent 102 and the inner tent 101. One end of the outer tent strut 81 is connected to the inner tent 101, and the other end of the outer tent strut 81 is connected to the outer tent 102. The outer tent strut 81 and the inner tent 101 can be connected in a fixed manner or in a fixed non-detachable manner, so as to make improvement according to requirements to the product and provide diversified products. The outer tent struts 81 are made of hard material, which improves the support strength of the outer tent struts 81 to the outer tent 102, improving the stability of the outer tent 102, and improving user experiences.

Figure 26:
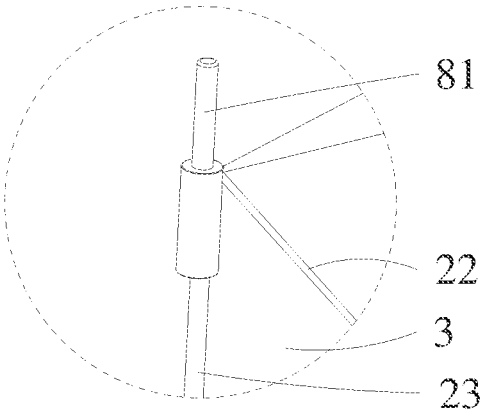
FIG. 26 is a schematic diagram of a fixed outer tent strut according to another embodiment of the present disclosure.
Figure 27:
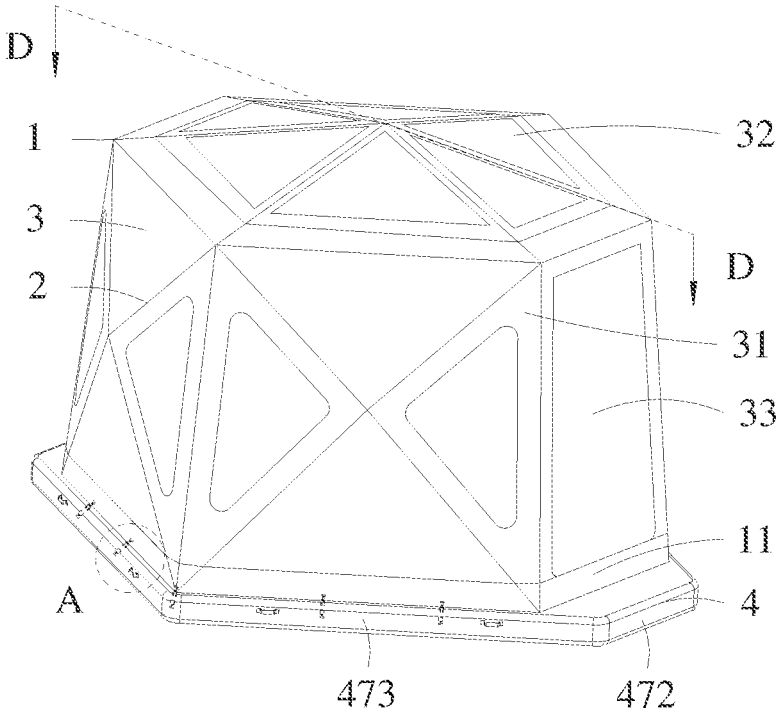
FIG. 27 is a schematic diagram of assembly of the base and the main body according to the embodiment of the present disclosure.
Figure 28:
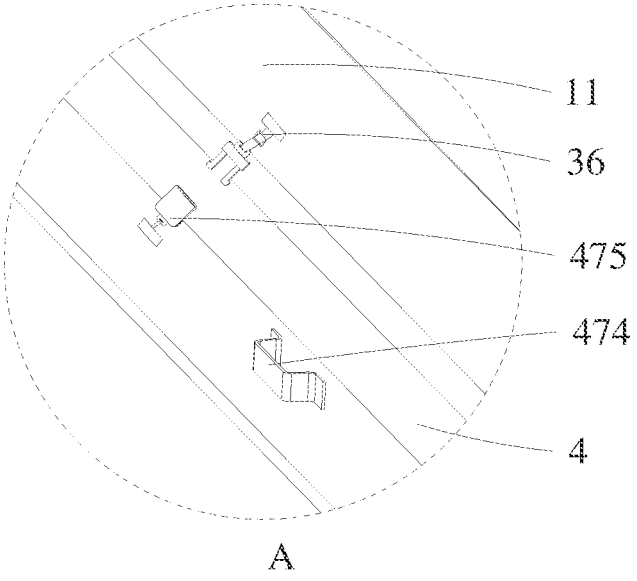
FIG. 28 is an enlarged schematic diagram of circle A in FIG. 27.
Figure 29:
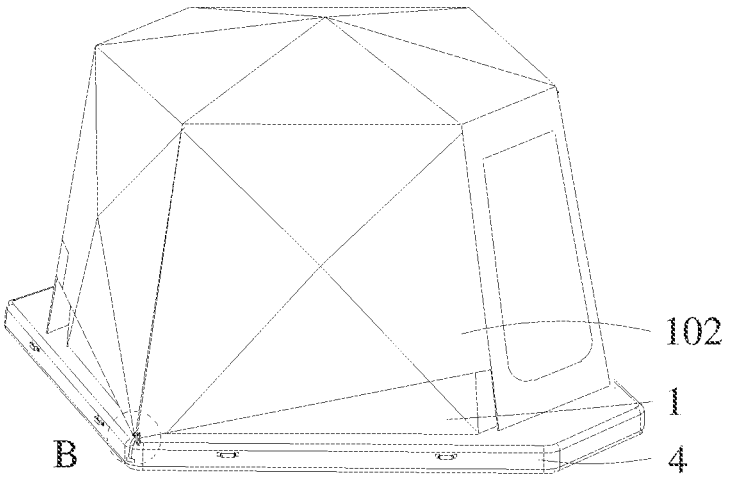
FIG. 29 is a schematic diagram of the connection between the outer tent and the base according to the embodiment of the present disclosure.
Figure 30:
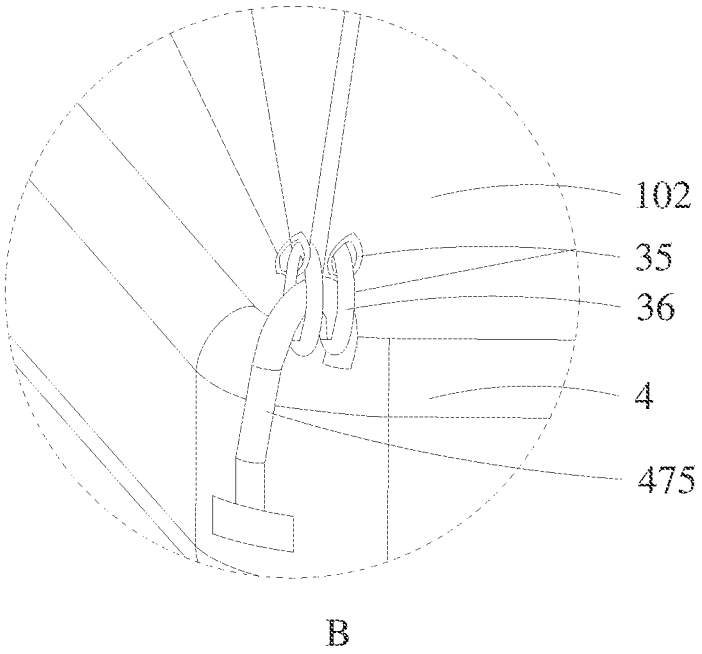
FIG. 30 is an enlarged schematic diagram of circle B in FIG. 29.
Figure 31:
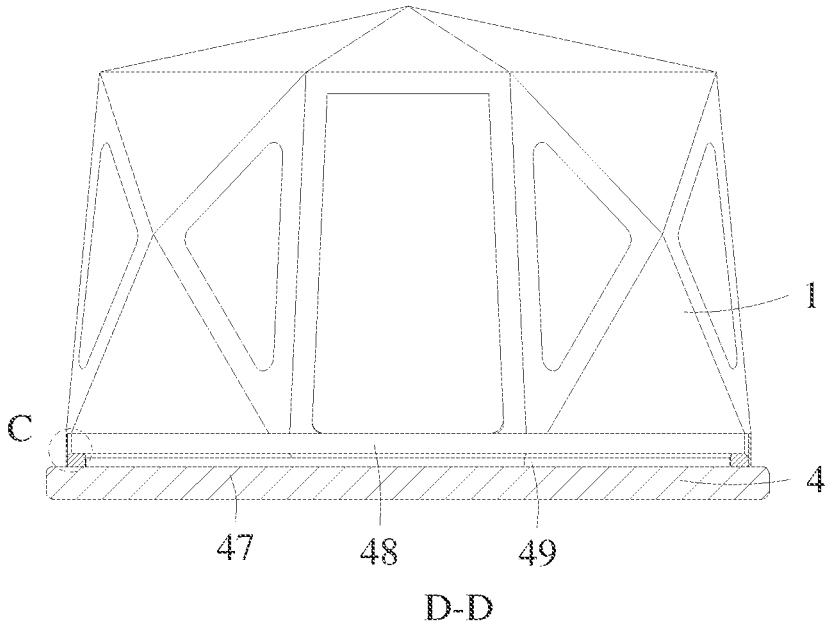
FIG. 31 is a schematic cross-sectional view along line D-D in FIG. 27.
Figure 32:
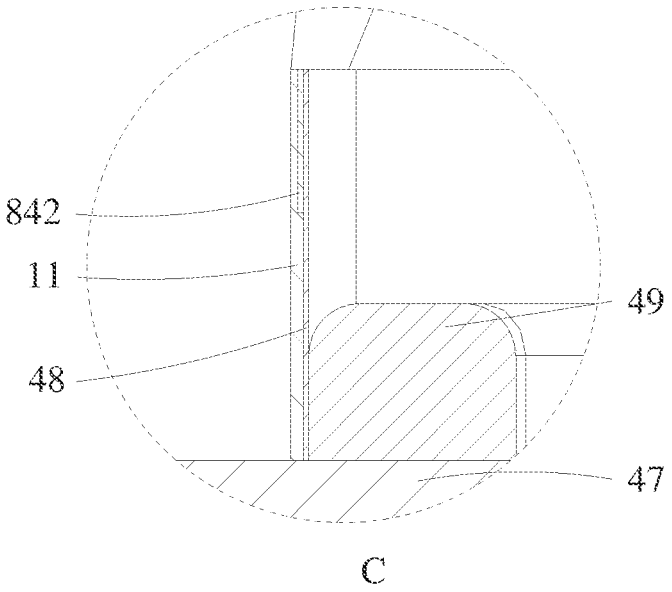
FIG. 32 is an enlarged schematic view of circle C in FIG. 31.

Further referring to FIG. 26, specifically, the end of the outer tent strut 81 close to the inner tent 101 can be integrally formed with the support member 22, so that the outer tent strut 81 is located at one end of the support member 22, and the outer tent strut 81 protrudes from the inner tent 101. The outer tent strut 81 is located at the end of the support member 22, and extends in the length direction of the support member 22. The integrally formed structure is convenient for production, and when the tent is assembled by users, the process of assembling the support member 22 with the outer tent strut 81 is reduced, improving convenience of installation by users. Similarly, the outer tent strut 81 can also be integrally formed with the strut member 23, and the strut member 23 exposed outside the inner tent 101 and the support member 22 of the outer tent struts 81 support the outer tent 102. Alternatively, the outer tent strut 81 is fixedly connected to the support member 22 by such as screws, bolts, welding, etc., and the fixed connection may be detachable or non-detachable.

Further referring to FIG. 24, the end of the outer tent strut 81 close to the inner tent 101 can also be engaged with the support member 22, and the outer tent strut 81 is engaged with the strut member 23. For example, an engaging structure is provided at an end of the outer tent strut 81, one end of the engaging structure being fixedly connected with the outer tent strut 81 and the other end provided with an open buckle, by which open buckle the outer tent strut is fixed to the support member 22 or the strut member 23. The buckle can either directly contact the support member 22 or the strut member 23, or be buckled on the support member 22 or the strut member 23 wrapped by the wall 3. Alternatively, one end of the outer tent strut 81 or the support member 22 is configured with a hollow interior, into which the other can be directly inserted to achieve fixation. Of course, alternatively, the outer tent strut 81 and the support member 22 are fitted by insertion when wrapped by the wall 3. That is, when the outer tent strut 81 and the support member 22 are connected by insertion, the wall 3 is arranged between the outer tent strut 81 and the support member 22, which can increase the inserting force therebetween, so that the outer tent strut 81 could be installed more stably. Alternatively, one end of the outer tent strut 81 is connected to the wall 3, and the wall 3 is provided with a cloth bag, in which the one end of the outer tent strut 81 is arranged. The cloth bag can be arranged at the joint of the top wall 32 and the side wall 31, and also can be directly arranged on the upper part of the side wall 31. Alternatively, on the bare support member 22 or the support member 22 wrapped by the wall 3 are provided strings, cloth strips, hook-and-loop fasteners, iron rings fixed by screws, cloth strips fixed by snap fasteners, etc. The outer tent strut 81 is detachably connected with the support member 22 or the strut member 23, which facilitates the replacement of the outer tent strut 81. At the same time, it is also convenient for the hollow and tight shape changes between the outer tent 102 and the top wall 32, realizing choices between multiple forms and improving user experiences.

In this embodiment, the method of connection between the outer tent strut 81 and the support member 22 can be applied to the connection between the strut member 23 and the outer tent strut 81.

The end of the outer tent strut 81 close to the outer tent 102 can directly abut against the outer tent 102, so that the outer tent strut 81 supports the outer tent 102. This structure is simple, and convenient for installation and disassemble, improving users' storage and installation efficiency. The end of the outer tent strut 81 close to the outer tent 102 can also be connected with the outer tent strut 81 and the outer tent 102 by a connector. For example, a connection gasket is provided at the joint of the outer tent strut 81 at the outer tent 102, and one end of the connection gasket is connected with the outer tent 102. The end of the connection gasket connected with the outer tent 102 has a contact area greater than the contact area between the outer tent struts 81 and the outer tent 102 when the outer tent struts 81 supports the outer tent 102, which reduces the contact pressure against the outer tent 102 during the contact, thereby reducing the possibility of damage due to the pressure force; when the gasket is connected to the outer tent strut 81, sleeves, screws, welding or integral molding can be used, improving the stability of the connection. Alternatively, a bag sleeve is directly provided on the outer tent 102, into which the top of the outer tent 81 is directly arranged when connection, achieving connection between the outer tent strut 81 and the outer tent 102. The joint between the cloth sleeve structure and the outer tent 102 is thickened to achieve the material strength of the outer tent 102. In addition, the cloth sleeve is a flexible structure, which reduces the possibility of scratches on the outer tent caused by hard materials, and at the same time, the cloth sleeve can protect the outer tent 102 from scratches caused by the outer tent strut 81.

Since the joint between the side wall 31 and the top wall 32 is roughly hexagonal, the outer tent strut 81 is arranged at the apex of the hexagon, which facilitates the installation of the outer tent strut 81 and can effectively support the outer tent 102. Alternatively, the outer tent strut 81 is only arranged at the apex where the door wall 33 and the top wall 32 are connected, and is only arranged on the top wall 32, which reduces the installation times of the outer tent strut 81, and it is easy to realize ventilation between the top wall 32 and the outer tent 102. Alternatively, a plurality of outer tent struts 81 are evenly arranged in a circumferential direction of the hexagon formed by the top wall 32, so as to improve strength of the support to the outer tent 102 and reduce the possibility of collapse of the outer tent 102.

Figure 25:
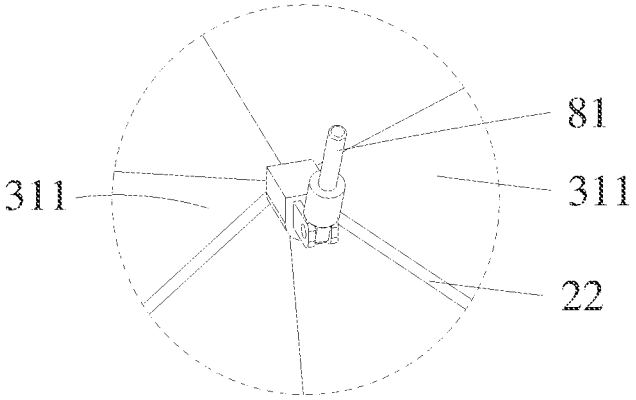
FIG. 25 is a schematic diagram of a rotating outer tent strut according to another embodiment of the present disclosure.

Further referring to FIG. 25, the outer tent strut 81 is provided with a rotating structure at one end close to the inner tent 101. One end of the rotating structure is fixed with the support member 22, the strut member 23 or the wall 3, and the other end of the rotating structure is connected with the outer tent strut 81. Of course, the fixation can be a detachable fixed connection or a non-detachable fixed connection. The rotating structure can be rotated at a fixed angle, that is, it can be fixed to a certain angle to achieve any angle adjustment. The rotating structure can enable the outer tent strut 81 to rotate between 0 and 180 degrees, and rotation of the outer tent strut 81 can adjust distance of a ventilation layer between the inner tent 101 and the outer tent 102, so as to realize different ventilation volumes and ventilation effects. When the outer tent strut 81 rotates by 90 degrees, there is a maximum distance between the outer tent 102 and the top wall 32, that is, the thickness of the ventilation layer is the largest, and the ventilation volume is the greatest; when it rotates by 0 degree, the outer tent 102 and the inner tent 101 fit together, achieving warm-keeping effect of the inner tent 101; when it rotates by 180 degrees, the outer tent struts 81 extend outward to support the outer tent 102. The length of the outer tent struts 81 can be between 5 cm-25 cm, such as 10 cm, 15 cm. If the outer tent struts 81 are too short, the ventilation effect cannot be reached; if the outer tent struts 81 are too long, the support stability is relatively low, making the installation difficult.

Specifically, the four outer tent struts 81 above the two door walls 33 are rotatable, and the two outer tent struts 81 on both sides of the top wall 32 are fixed, so that the ventilation volume is adjustable and fixation stability of the entire outer tent 102 can be increased.

The top wall 32 of the inner tent 101 is provided with a through hole, through which the ventilation layer between the inner tent 101 and the outer tent 102 is communicated with inner space of the inner tent 101, and through which ventilation can be achieved between inside and outside of the inner tent 101. When the inner tent 101 is provided individually, the inner tent 101 can achieve direct air exchange with the outside through the through hole. A gauze tent can also be provided at the through hole to realize ventilation, anti-mosquito effect and viewing outside through the through hole, which improves users' experience.

When the outer tent 102 is arranged above the top wall of the inner tent 101, the outer tent 102 can block the scorching sun and rain. The ventilation layer between the outer tent 102 and the inner tent 101 are communicated with the top wall 32, which reliefs oppression of the inner tent 101 and improves users' experience inside the inner tent 101. By adjusting the rotation of the outer tent struts 81, the ventilation volume can be increased or decreased, thereby changing the temperature inside the inner tent 101, which improves users' experience.

Figure 4:
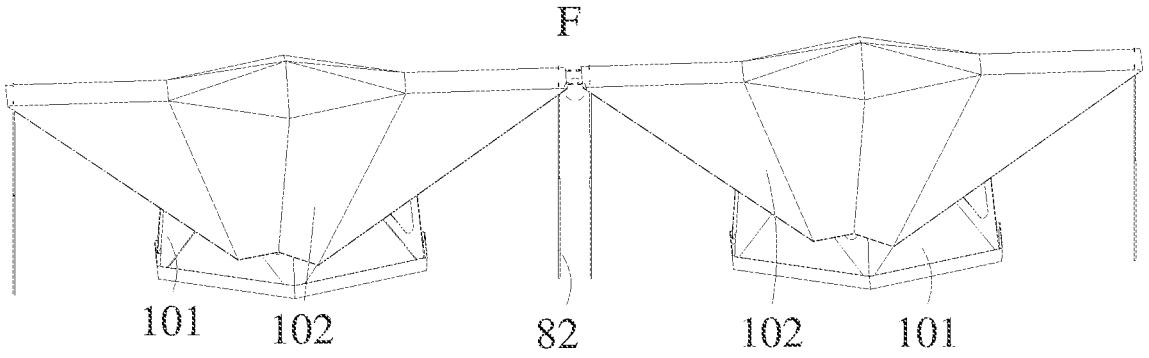
FIG. 4 is a schematic diagram of multi-tent linkage according to an embodiment of the present disclosure.

Further referring to FIG. 1, FIG. 3 and FIG. 4, there are multiple combinations between the inner tent 101 and the outer tent 102. For example, the outer tent 102 can wrap the inner tent 101; the middle part of the outer tent 102 is connected to the top wall 32 of the inner tent 101, and edges of the outer tent 102 are unfolded; or a plurality of tents are connected via the outer tents 102 to form tents linked together.

The tent also includes a gate rod 82. The middle part of the outer tent 102 is supported by the top wall 32 of the inner tent 101, or the middle part of the outer tent 102 is supported by the frame 2, and the connection of the middle part of the outer tent 102 with the top wall 32 of the inner tent 101 or the frame 2 is detachable. The outer edges of the outer tent 102 are supported by a plurality of gate rods 82, so that the entire outer tent 102 is in an unfolded state, so that the outer tent 102 covers the entire inner tent 101, and projection of the inner tent 101 to the outer tent 102 falls within the outer tent 102. The area adjacent around the inner tent 101 is located under the outer tent 102, thereby increasing the activity space of the tent, improving users' experience, and improving the overall aesthetic feeling of the outer tent 102 and the inner tent 101.

The outer tent 102 is a large structure, and the area of the outer tent 102 is at least greater than or equal to, for example, 1.5 times 2 times or 2.5 times the area of the top wall 32, so that the outer tent 102 has a better blocking effect, and the outer tent 102 has a larger area when unfolded, increasing the activity area of users under the outer tent 102. If the outer tent 102 is too small, the users' activity area under the outer tent 102 will be small, thereby reducing the users' outdoor experience. The outer tent 102 with a larger area has a better effect of wrapping the inner tent 101.

Figure 6:
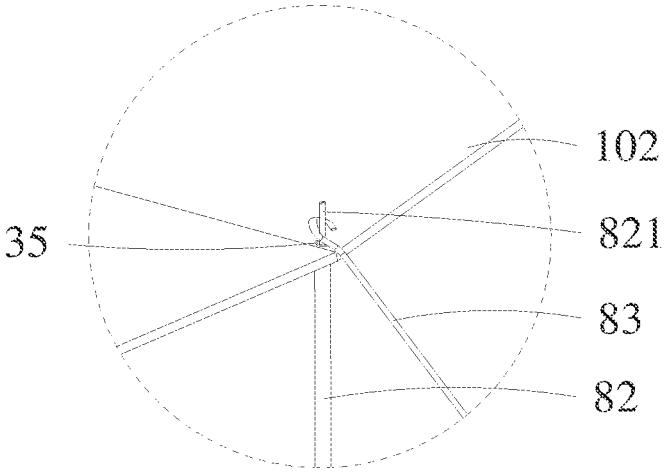
FIG. 6 is an enlarged schematic diagram of circle C in FIG. 1.

Further referring to FIG. 6, when fully unfolded, the outer tent 102 can be completely supported by the gate rods 82, so that the height of the edge of the outer tent 102 is higher than or equal to the height of the side wall 31. For example, a gate rod 82 is provided at each corner of the outer tent 102, with one end close to the ground directly mounted to or inserted into the ground. Alternatively, some protruded tent pegs, fixing sleeves or the like could be provided on the grounds to be fitted to the gate rods 82, and the ends of the gate rods 82 closing to the ground are inserted into the sleeves, or the pegs are inserted into the ends of the gate rods 82 closing to the ground and then secured by screws or buckles, etc. to improve stability of the connection. Alternatively, the gate rods 82 could be fixed to the ground in other methods. The gate rods 82 are close to one end of the outer tent, and they can directly abut against the outer tent 102. Alternatively, the outer tent 102 could be provided with cloth sleeves, into which the gate rods 82 are inserted, making stability of the connection between the gate rods 82 and the outer tent 102 better and getting a greater supported height of the outer tent 102 so that it is not easy to fall off at the joints. Metal rings 35 are provided on the outer tent 102, and they are fixed on the outer edge of the outer tent 102 by means of riveting, engagement, etc. The metal rings 35 are provided with a through hole or an engaging structure. The gate rods could be inserted into the holes of the metal rings 35 directly, or the gate rods 82 could be provided with a structure fitted with the engaging structure of the metal rings 35, so that the gate rods 82 and the metal rings 35 are fixed or detachably connected, improving stability of connection of the gate rods 82 and the outer tent 102, and making the outer tent 102 more upright and more beautiful as a whole.

Specifically, the gate rods 82 are retractable rods, which is convenient for storage and transportation. The gate rods 82 are provided with mark points, so that users can fix them with reference to the mark points. The mark points show that the total length of the retractable rods is 2 meters. Of course, other lengths can also be marked, such as 2.2 meters, 1.8 meters, etc. The gate rods 82 could be adjusted in a stepless manner, that is, the height can be fixed at will between 1.5 m and 2.5 m, and the mark points give users a relatively appropriate height for installation, and stepless adjustment gives users more independent adjustments, which can improve users' experience. The gate rods 82 also includes a door protrusion 821, which is integrally formed with the gate rods 82, and can also be fixed on the ends of the gate rods 82 by insertion, welding, engagement, etc. The door protrusion 821 is generally cylindrical, with a diameter smaller than the diameter of the gate rod 82, the diameter of the metal ring 35 hole is larger than the diameter of the door protrusion 821 and smaller than the diameter of the gate rod 82, so that the metal ring 35 is sleeved on the door protrusion 821 and will not disengage downward. One end of the gate rod 82 is connected to the metal ring 35 of the outer tent 102, and the other end thereof abuts against the ground. The tent includes a wind rope 83, with one end sleeved on the gate protrusion 821 so that the gate rod 82 supports the metal ring 35, the metal ring 35 supporting the one end of the wind rope 83, and the other end away from the direction of the door wall 33 of the inner tent 101 and fixed to the ground by the pegs, thereby stabilizing the gate rod 82, reducing the possibility of the gate rod 82 inclining to the direction of the outer tent 102, and thereby improving the windproof performance of the entire outer tent 102.

The outer tent 102 is polygonal, and edges of the outer tent 102 are upfolded or fixed by combinations of metal ring 35, gate rods 82, wind ropes 83 and pegs at each corner of the outer tent 102. If the polygon side length of the outer tent 102 is too long, one or more gate rods 82 can be provided in an intermediate portion of the side length, which reduces possibility of collapse of the outer tent 102, not only making the tent more upright and good-looking, but also increasing users' activity area under the outer tent 102. Of course, the outer tent 102 can also be in other shapes such as a circle, and it can also be supported by a combination of a plurality of metal rings 35, gate rods 82, wind ropes 83 and pegs, which will not be repeated in detail here.

Further referring to FIG. 19, a button ring 841 is provided at the joint of the door wall 33, the window side wall 311 and the top wall 32, or on the top wall 32 near the joints, and the outer tent 102 is provided with a button 84 corresponding to the button ring 841. The button 84, conical or cylindrical, can be fixedly connected with the outer tent 102. The button 84 can also be connected with the outer tent 102 through an elastic rope, and the button ring 841 can also be made of an elastic rope. When installed, the button 84 axially passes through the button ring 841, so that the button 84 and the button ring 841 are snapped together, which is convenient for users to assemble and disassemble the button 84 and the button ring 841. The elastic rope has elasticity, so that there is a certain margin during and after the connection, which is convenient for installation and positioning, simplifying the manufacturing process and lowering the cost. The outer tent 102 is not easy to wrinkle when the installation is completed. The button 84 and the button ring 841 positioned above the door wall 33 and at the top wall 32 are set with one color, and the buttons 84 and the button ring 841 positioned above the window side wall 311 and at the top wall 32 are set with another color, to facilitate users matching them when installing the outer tent 102, which improves convenience of installation. Alternatively, each pair of corresponding button 84 and button ring 841 have the same color or a unique mark, helping users matching them better.

Further referring to FIG. 1, when the outer tent 102 is partially unfolded, the part positioned at the front or the upper front of the two door walls 33 is in an unfolded state, and the part positioned at the front or the upper front of the window side wall 311 is fixed to the tent or the ground, and at this time the height of the edge of the outer tent 102 positioned at the front of the window side wall 311 is lower than the height of the edge of the outer tent 102 positioned at the front of the door wall 33, and the height of the edge of the outer tent 102 positioned at the front of the door wall 33 is higher than or equal to that of the side wall 31. Of course, it can be understood that the height of the edge of the outer tent 102 located at the front of the door wall 33 may be approximately the same as or slightly lower than the height of the side wall 31.

Specifically, two gate rods 82 are provided in front of the door wall 33 to support the outer tent 102 in front or upper front of the door wall 33. The fixing method is the same as that when the outer tent 102 is upfolded, that is, upfolding or fixing the outer tent using combination of the metal rings 35, gate rods 82, wind ropes 83 and pegs. When the outer tent 102 in upper front of the door wall 33 is stretched, the height of the stretched outer tent 102 is approximately the same as the height of the joint between the door wall 33 and the top wall 32, which improves users' experience.

Figure 5:
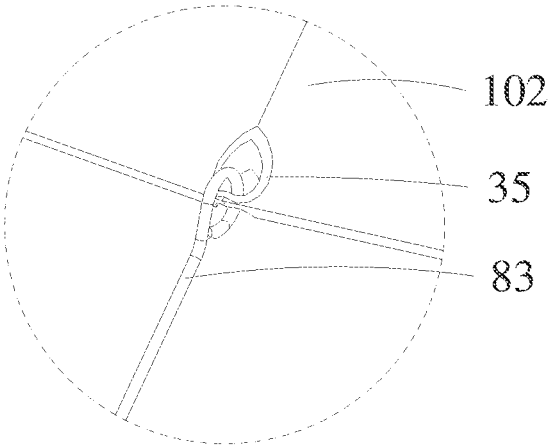
FIG. 5 is an enlarged schematic view of circle B in FIG. 1.
Figure 7:
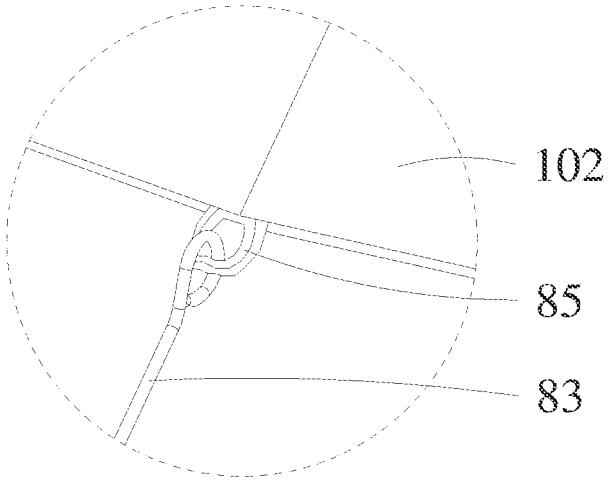
FIG. 7 is a schematic diagram of the connection between the outer tent and the wind rope according to another embodiment of the present disclosure.

Further referring to FIG. 5 and FIG. 7, a metal ring 35 or a cloth fixing ring 85 is provided at the edge of the outer tent 102 positioned in front or upper front of the window side wall 311, and the metal ring 35 or the cloth fixing ring 85 are fixedly connected with the outer tent 102. In front of the two window side walls 311 on one side of the door wall 33, the number of the cloth fixing rings 85 or metal rings 35 is determined according to the edge length of the outer tent 102. For example, there could be 1, 2, 3 or 5 cloth fixing rings 85, and each could be fixed by wind ropes 83 to enhance the strength of the outer tent 102. The cloth fixing ring 85 or the metal ring 35 is connected to one end of the wind rope 83, and the other end of the wind rope 83 is fixed to the ground through pegs, which improves the stability of the outer tent 102. Users can choose the distance between the pegs and the tent to upfold the outer tent 102 at different angles. Certainly, the cloth fixing ring 85 or metal ring 35 also can be directly connected with an elastic rope, to which a peg is connected, so that the outer tent 102 that is positioned at the window side wall 311 is in a state of wrapping the inner tent 101, improving stability of the tent, reducing influence of side wind and oblique sunlight on the inside of the inner tent 101 and thereby improving users' experience. It is also possible to fix multiple cloth fixing rings 85 or metal rings 35 through one peg at the same time, so as to improve the convenience of installation for users.

Further referring to FIG. 3, when the outer tent 102 wraps the inner tent 101, the gate rod 82 is retracted and stored, and the outer tent 102 located in front or upper front of the door wall 33 is directly connected to the pegs through the metal ring 35 or the elastic rope and fixed to the ground. The outer tent 102 can also be fixed by means of wind ropes 83, metal rings 35 and pegs. Of course, the outer tent 102 can also be fixed to the inner tent 101 by means of hooks, buckles, magnetic attractors, snap fasteners or hook-and-loop fasteners.

Figure 8:
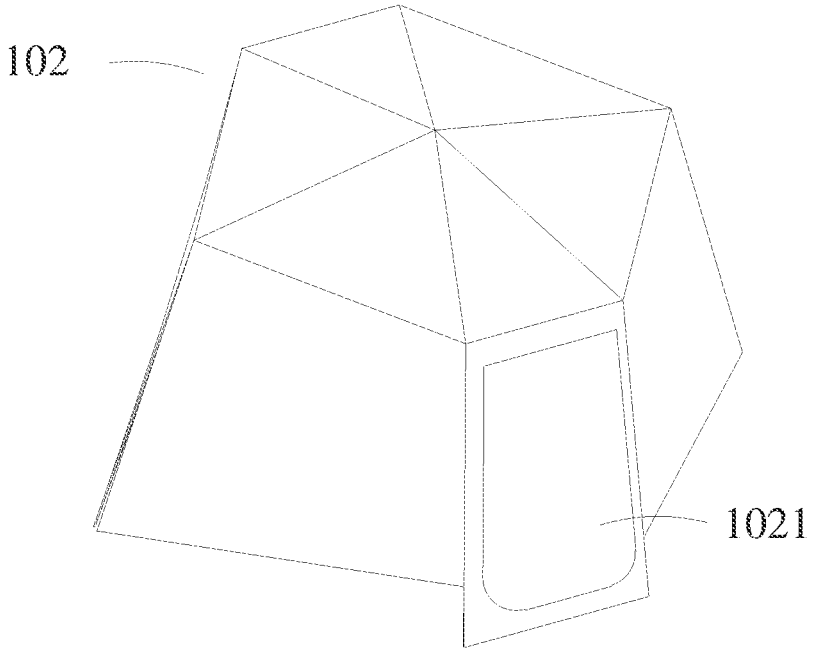
FIG. 8 is a schematic diagram of the structure of the outer tent wrapping state according to an embodiment of the present disclosure.

Further referring to FIG. 8, specifically, when the outer tent 102 wraps the inner tent 101, the area where one of the door walls 33 faces right to the outer tent 102 is provided with an outer tent opening 1021 having a zipper that can open the outer tent opening 1021. The area of the outer tent opening 1021 opened by the zipper on the outer tent 102 is greater than or equal to the area of the door wall 33, so that a user could open the outer tent opening 1021 to enter the inner tent 101 from the outer tent opening through the outer tent 102 first and then the door wall 33 when the outer tent 102 wraps the inner tent 101. Of course, it could be understood that the zipper can be replaced with detachable connecting parts such as hook-and-loop fasteners, snap fasteners, and buckles. A male sticker of the hook-and-loop fastener is provided in an area of another door wall 33 facing right to the outer tent 102 or in vicinity of the area, and a corresponding female sticker of the hook-and-loop fastener is provided in an area facing the window side wall 311. When the female sticker of the hook-and-loop fastener and the male sticker of the hook-and-loop fastener are fitted for fixation, the outer tent 102 wraps the inner tent 101 with better fit and tightness, which improves the overall stability of the wrapped outer tent 102 and inner tent 101, leading to better wind resistance and heat insulation effect inside the inner tent 101 and improving users' outdoor camping experience. Of course, zippers can be provided at the outer tents 102 facing the two door walls 33, so that the user can enter and exit from the two door walls 33 conveniently.

Figure 9:
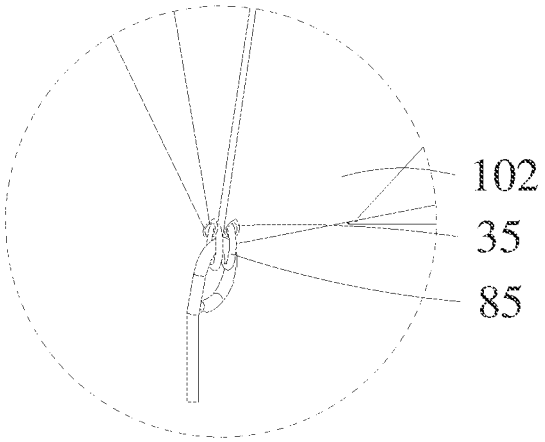
FIG. 9 is an enlarged schematic diagram of circle D in FIG. 3.
Figure 12:
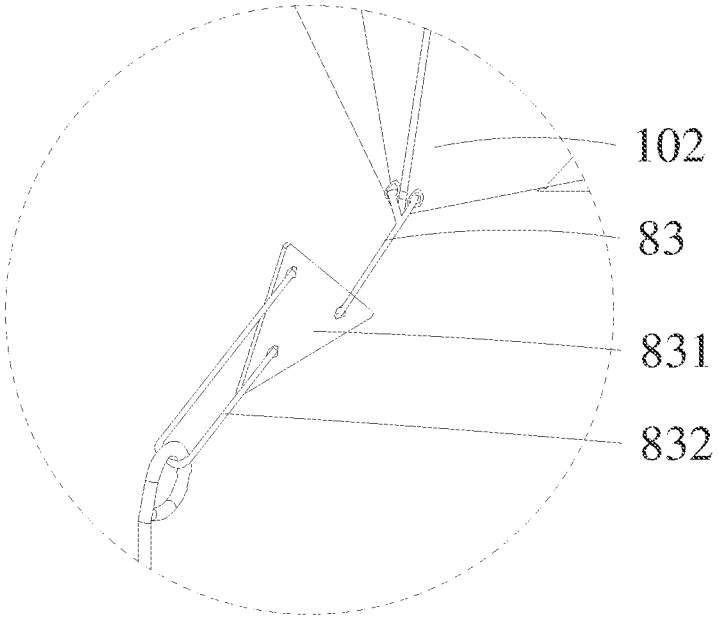
FIG. 12 is a schematic diagram of fixing the outer tent in the tent wrapping state according to another embodiment of the present disclosure.

Further referring to FIG. 9 and FIG. 12, in the area of the outer tent 102 opposite to the window side wall 311, the cloth fixing ring 85 on the edge thereof is directly fixed to the ground with the peg through the elastic rope, and the elastic rope brings a certain margin to the installation and fixation, improving convenience of installation and reducing damage to the fabric of the outer tent 102 caused by excessive rigidity. A plurality of cloth fixing rings 85 or metal rings 35 arranged in front of the side window side wall 311 on one side are fixed by one peg, or by multiple pegs, so as to improve fixing convenience and the whole stability of the tent.

Specifically, three cloth fixing rings 85 or metal rings 35 are arranged in front of two adjacent window side walls 311 on one side. The cloth fixing ring 85 can be made of elastic cloth, and an elastic rope can also be arranged on the cloth fixing ring 85, and the cloth fixing ring 85 is directly or indirectly connected to the peg through the elastic rope. The two of the three cloth fixing rings 85 at both ends are attached to each other, the wall 3 and the cloth fixing ring 85 in the middle are close to the inner tent 101, and after being attached the cloth fixing rings 85 at both ends are fixed with a peg. At this time, the outer tent 102 located at the window side wall 311 is relatively upright and flat, which improves the users' visual experience.

Specifically, the wind rope 83 includes an anti-slip sheet 831 and a nylon rope 832. The anti-slip sheet 831 is roughly in the shape of an isosceles obtuse triangle with three through holes on the three corners of the triangle. One end of the nylon rope 832 is fixed to the hole at one of the acute angles, and the other end of the nylon rope 832 passes through the hole at another acute angle on one side of the anti-slip sheet 831, and finally the nylon rope 832 continues to pass through the obtuse angle hole on the other side. At this time, one end of the nylon rope 832 is fixed on the anti-slip sheet 831, and the other end is fixed on the inner tent 101 or the outer tent 102 of the tent for fixing the inner tent 101 or the outer tent 102. The nylon rope 832 located between the two acute angles can be fixed to the ground with pegs in the middle, and the user can shrink the wind rope 83 by moving the anti-slip sheet 831 to improve the tightness of the wind rope, and then adjust the tightness, length and the like of the wind rope 83 as required.

Figure 10:
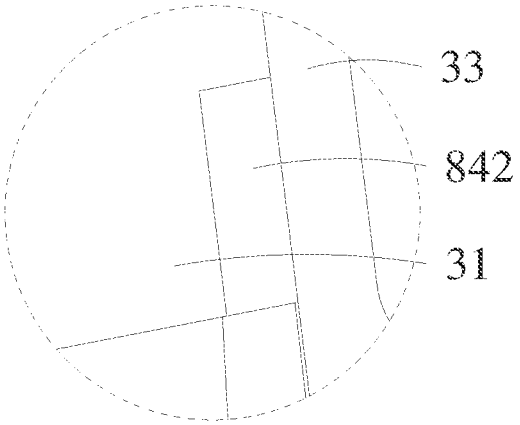
FIG. 10 is an enlarged schematic diagram of circle E in FIG. 3.

Further referring to FIG. 10, the outer tent 102 is provided with a sticking area 842 located at a fixing place of a hook-and-loop fastener. When the outer tent 102 wraps the inner tent 101, it can be fixed with a hook-and-loop fastener. At the two door walls 33 are provided a whole hook-and-loop fastener or multiple separate hook-and-loop fasteners for fixation and stickup, so that the outer tent 102 is attached to the inner tent 101. It can be tightened at the folds, and then fixed with the hook-and-loop fastener. The hook-and-loop fastener is also provided on the edge of the outer tent 102. The edge of the outer tent 102 can be stuck to the lower part of the inner tent 101, so that all or most of the outer tent 102 wraps the window side wall 311 of the inner tent 101. Of course, the hook-and-loop fastener can be replaced by other detachable connection methods such as magnetic attractors, buckles, snap fasteners and so on.

Figure 11:
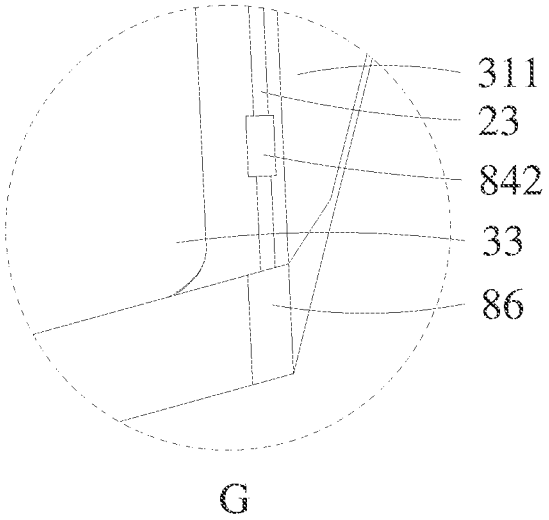
FIG. 11 is an enlarged schematic diagram of circle G in FIG. 2.
Figure 13:
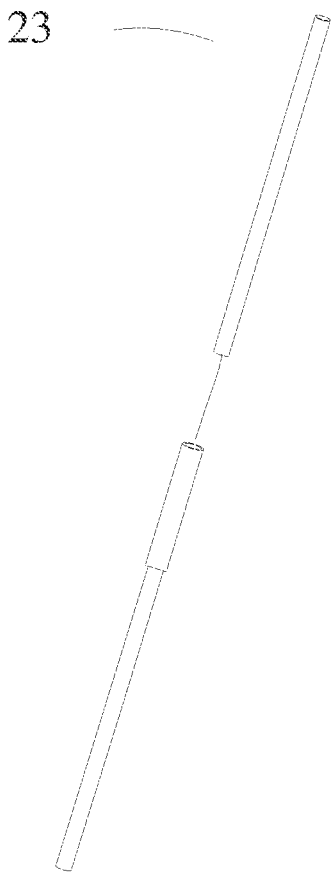
FIG. 13 is a perspective schematic diagram of an open state of a strut member according to an embodiment of the present disclosure.

Further referring to FIG. 11 and FIG. 13, specifically, the strut members 23 are located inside or outside the inner tent 101, the strut members 23 are located at both ends or both sides of the door wall 33, or the strut members 23 are located at the joint of the door wall 33 and the window side wall 311. At an upper part of the door wall 33, or at an upper part where the door wall 33 and the window side wall 311 are connected, or at the joint of the door wall 33, the top wall 32 and the window side wall 311, an installation bag 86 is provided, with an opening downward. At a lower part of the door wall 33 or at a lower part where the door wall 33 and the window side wall 311 are connected, another installation bag 86 is provided, with an opening upward. The installation bag 86 at the upper part and the installation bag 86 at the lower part have their openings arranged oppositely. When the strut member 23 is installed, the strut member 23 is detachable in the middle and connected with a sleeve. The upper and lower ends of the strut member 23 are first placed inside the two installation bags 86, and the strut member 23 in the middle is then fixed with the sleeve. A hook-and-loop fastener is arranged in the middle of the strut member 23, and the hook-and-loop fastener is located at the sticking area 842. The hook-and-loop fastener fixes the strut member 23 on the door wall 33 to further fix the strut member 23, improving stability of the support. The strut members 23 can support the door wall 33, reducing the possibility of collapse of the door wall 33, thereby improving the users' visual experience.

Figure 14:
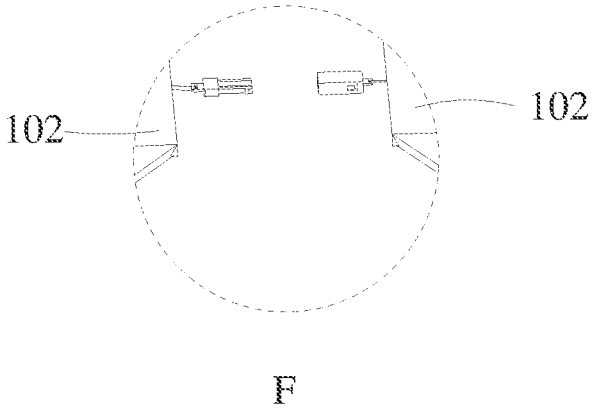
FIG. 14 is an enlarged schematic diagram of circle F in FIG. 4.

Further referring to FIG. 4 and FIG. 14, when multiple tents are used together, the outer tents 102 are unfolded at the same time, and the door walls 33 of adjacent tents are arranged oppositely. The outer tents 102 are fixedly connected in a detachable manner, using such as buckles, magnetic attractors, snap fasteners, hook-and-loop fasteners, etc. Two adjacent outer tents 102 are connected, so that a communication channel is formed under the outer tents 102, which facilitates the interaction between adjacent tents, and improves the space for activities and article placement under the outer tents 102, thereby enhancing users' social experience. Two adjacent outer tents 102 are connected in front or upper front of the door wall 33.

In some embodiments, the outer tent 102 is a small structure. The area of the outer tent 102 is greater than the area of the top wall 32, and the area of the outer tent 102 is no more than 1.3 times the area of the top wall 32, so that the outer tent 102 is light and easy to carry and it is convenient for users to install it on the inner tent 101. If the outer tent 102 is too large, it is inconvenient to carry and install, and if the outer tent 102 is too small, it will not be able to block the inner tent 101.

Figure 16:
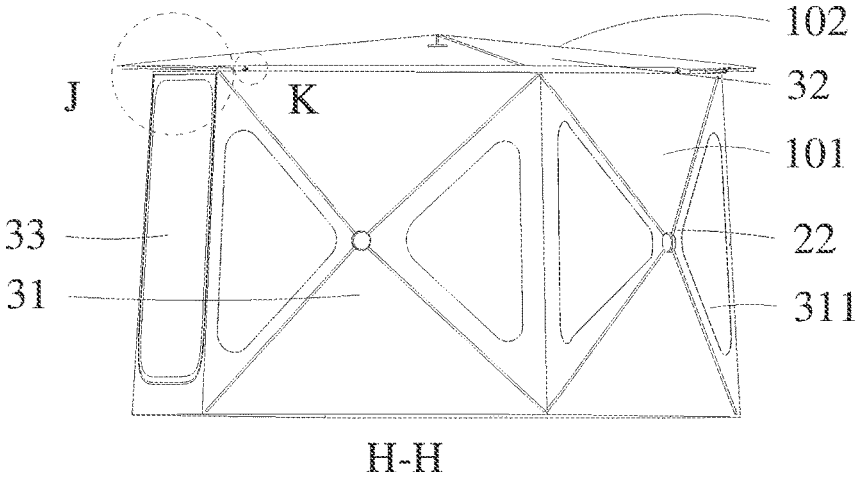
FIG. 16 is a schematic cross-sectional view along line H-H in FIG. 15.
Figure 18:
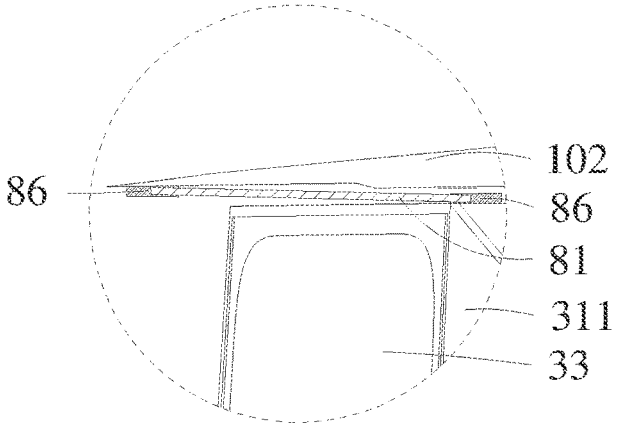
FIG. 18 is an enlarged schematic diagram of circle J in FIG. 16.

Further referring to FIG. 16 and FIG. 18, the edge of the outer tent 102 positioned in front or upper front of the door wall 33 and the inner tent 101 are connected and supported by the outer tent struts 81. The edge of the outer tent 102 is provided with an installation bag 86, and another installation bag 86 is correspondingly provided on the top wall 32. The installation bags 86 are sewn with cloth bag, which could be made of the same material as the wall 3. One end of the installation bags 86 is open and the other end is closed. The strength of the installation bags 86 is improved by multiple stitching or increasing the thickness of the cloth at the closed end, which reduces the possibility of damage during use. The opening of the installation bag 86 positioned at the outer tent 102 is facing towards the direction of the door wall 33, specifically toward the opening of the installation bag 86 facing the top wall 32. The opening of the installation bag 86 on the top wall 32 is facing toward the edge of the outer tent 102, specifically toward the installation bag 86 on the edge of the outer tent 102. The two installation bags 86 are arranged opposite to each other, which is convenient for users to install the outer tent strut 81.

When installing the outer tent strut 81, one end of the outer tent strut 81 is first installed into the installation bag 86 of the top wall 32, then by pulling the edge of the outer tent 102 slightly, the other end of the outer tent strut 81 is installed in the installation bag 86 on the edge of the outer tent 102, thereby realizing the partial connection between the outer tent 102 and the inner tent 101, and the level of the installation bag 86 positioned on the edge of the outer tent 102 is lower than the level of the installation bag 86 positioned at the top wall 32. Under the action of the outer tent struts 81, the edge of the outer tent 102 extends obliquely downward, so that the outer tent 102 is less affected by the wind force, the outer tent 102 has stronger stability and stronger wind resistance, and the outer tent 102 is not easy to be overturned. The top wall 32 is high in the middle and low at the edge. The top wall 32 is also provided with an installation bag 86 for installing the support member 22. The installation bag 86 for installing the support member 22 has an opening inclining upward and toward the highest part of the top wall 32. The installation bag 86 of the support member 22 at the top wall 32 and the installation bag 86 of the outer tent strut 81 are both located at the joint of the door wall 33, the window side wall 311 and the top wall 32, and are located on the top wall 32. The two installation bags 86 on the top wall 32 are arranged adjacent to each other to facilitate manufacturing and reduce manufacturing costs.

Specifically, the two door walls 33 have four joints of the door walls 33, the window side walls 311 and the top walls 32 in total, and the four joints of the door walls 33, the window side walls 311 and the top walls 32 are all provided with an installation bag 86, and on the edge of the outer tent 102 is also provided a corresponding installation bag 86, which can realize the installation of four outer tent struts 81. After the installation is completed, strength and aesthetics of the connection between the outer tent 102 and the inner tent 101 both are enhanced.

Figure 17:
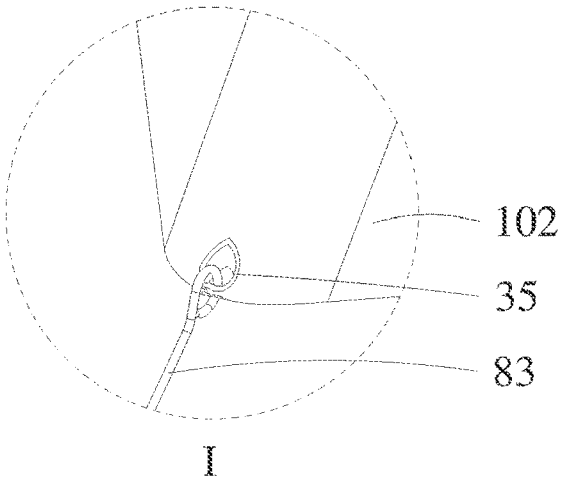
FIG. 17 is an enlarged schematic diagram of circle I in FIG. 15.

Referring to FIG. 17, the outer tent 102 is located at a part of the window side wall 311. A metal ring 35 or a cloth fixing ring 85 is provided at the edge of the outer tent 102, and the metal ring 35 or the cloth fixing ring 85 are fixedly connected with the outer tent 102. In front of the two window side walls 311 on one side of the door wall 33, the number of the cloth fixing rings 85 or metal rings 35 is determined according to the edge length of the outer tent 102. For example, there could be 1, 2, 3 or 5 cloth fixing rings 85, and each is connected with one end of the buckle or the wind rope 83. The other end of the wind rope 83 or the buckle could be connected with the wall 3, the frame 2 or the ground to fix the outer tent. The wind rope 83 or the buckle can be fixed by the connecting parts on the wall 3 or the frame 2, such as tying the wind rope 83 to the wall 3, tying the wind rope 83 to the frame 2, and engaging the buckle with the frame 2, etc. They are all in the form of realizing the fixation of the wind rope 83 or the buckle. The other end of the wind rope 83 can be fixed to the ground by pegs, which improves the stability of the outer tent 102, and user can choose the distance between the pegs and the tent, so as to realize the unfolded forms of the outer tent 102 at different angles. Of course, the buckles can be connected with the outer tent 102 through some elastic ropes, so that there is a certain margin during and after the connection, which is convenient for installation and positioning, simplifies the manufacturing process, lowers the cost and prevents wrinkles of the outer tent 102 after the installation.

Under the combined action of the outer tent strut 81, the wind rope 83 and the button ring 841, etc., the connection between the outer tent 102 and the inner tent 101 and the fixing of the outer tent 102 are realized, which improves the overall stability of the tent and also makes the inner tent, under the protection of the outer tent 102, have the effect of rain and wind resistance at the top wall 32 or the side wall 31, which improves the users' experience. The outer tent 102 in front or upper front of the door wall 33 forms the eaves of the door wall 33, making the whole tent more aesthetic.

It can be understood that the outer tent 102 is located at the part of the window sidewall 311, and one of the polygonal corners of the outer tent 102 is located at the joint of two adjacent window sidewalls 311. When the outer tent 102 is fixed, one of the polygonal corners of the outer tent 102 is fixed at the joint of the two window side walls 311 by a structure such as a buckle. Alternatively, a wind rope 83 is tightened for fixation, and the tightened direction of the wind rope 83 is in an extending direction of the connecting slit of the two window side walls 311, so that the outer tent 102 is tightened with the same force on left and right, which can not only improve the service life of the outer tent 102, but also allow the outer tent 102 to be more upright after being fixed.

Figure 21:
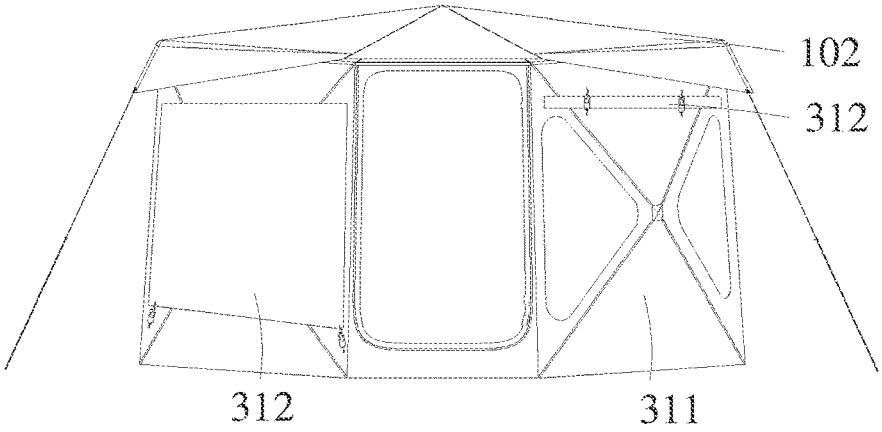
FIG. 21 is a schematic diagram of the connection between the inner tent and the curtain according to an embodiment of the present disclosure.

In some embodiments, as shown in FIG. 21, the wall 3 includes a curtain 312 having a quadrangular shape with a wide side and a long side. When unfolding, one wide side of the curtain 312 is connected with the upper end of the window side wall 311, and the other wide side of the curtain 312 is connected with the lower end of the window side wall 311. Specifically, the wide side of the upper end of the curtain 312 is connected with the joint of the window side wall 311 and the top wall 32, or the curtain 312 is connected with the window side wall 311 near the joint of the window side wall 311 and the top wall 32. A corner of the wide side of the lower end of the curtain 312 is connected with the joint of the window side wall 311 and the door wall 33, or a corner of the lower end of the curtain 312 is connected with the window side wall 311 near the joint of the window side wall 311 and the door wall 33. The other corner of the wide side of the lower end of the curtain 312 is connected with the joint of the two window side walls 311 or near the joint of the two window side walls 311.

The upper end of the curtain 312 is fixedly connected with the window side wall 311, and can be sewn integrally therebetween, or can be fixed in a detachable manner, such as using hook-and-loop fasteners, hooks, snap fasteners, zippers, etc. The lower end of the curtain 312 is fixed by the button 84 and the button ring 841, and the button 84 can also be connected to the curtain 312 by an elastic rope, so that there is a certain margin for the connection, improving convenience of users' installation. Of course, the lower end and the two side ends of the curtain 312 can be installed in other detachable ways such as using hook-and-loop fastener.

The curtain 312 is used to cover the window on the window side wall 311, reducing the possibility of the setting sunshine, the wind, and the rainwater entering the inner tent 101, further protecting the inner tent 101, and achieving warm keeping function of the curtain 312 to a certain extent. The minimum area of the curtain 312 should be proximately the same in size as the window to ensure that the window can be fully covered. In the present disclosure, the area of the curtain 312 is about 0.5 to 1.3 times that of the window of window side wall 311.

The curtain 312 can be folded upwards, and the curtain 312 can be fixed to the fixing position on the upper end of the curtain 312, and the button 84 and the button ring 841 can be located around the curtain 312 and fix the same.

Figure 33:
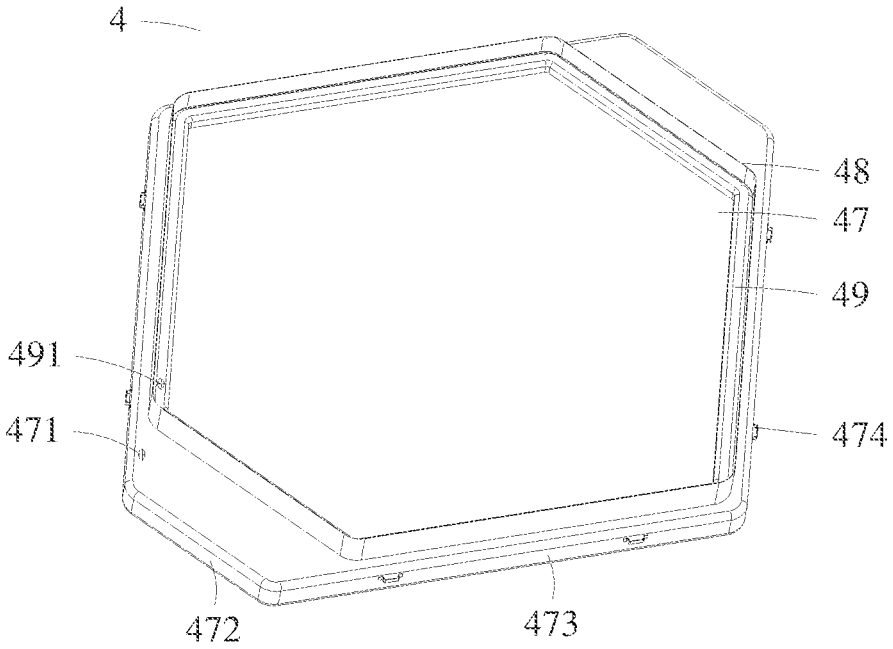
FIG. 33 is a schematic perspective view of the base according to an embodiment of the present disclosure.

Further referring to FIG. 33, the base 4 can be a hard base, such as a wooden board; it can also be a soft base, such as a rubber material. The base 4 can also be an inflatable cushion, and the surface of the inflatable cushion is made of PVC material, and PVC has better connectivity and adhesiveness. Alternatively, the base 4 includes a base body 47 having a top wall, a bottom wall and a side wall, wherein the top wall or the bottom wall of the inflatable cushion is made of hard or semi-hard material, and the side wall is made of soft material. The top wall of the inflatable cushion is made of hard material or semi-hard material, which makes the surface smoother and reduces the possibility of collapse, so that users can move better on the surface of the inflatable cushion. The bottom wall is made of hard material or semi-hard material, so that the entire inflatable cushion is more stable and users do not need to consider the impact of the bottom pit when placing the inflatable cushion. In present disclosure, the outer surface of the base body 47 is made of PVC material, and the material cost is low, and fixation between the side wall and the top wall and between the side wall and the bottom wall is achieved by stickup, which is very simple. The inflatable cushion is provided with a wire drawing structure forming wire drawing material. The outer layer of the wire drawing material is bonded to the PVC material, so as to realize the molding of the entire base 4. The wire drawing structure is used to connect the top wall and the bottom wall of the inflatable cushion, and has the stretching effect between the top wall and the bottom wall. The dense wire drawing structure can make the inflatable cushion have an explosion-proof effect. When it is pierced by a sharp object, under the pulling force of the wire drawing structure, the puncture hole reduces possibility of external explosion, thereby improving the explosion-proof effect.

The thickness of the base body 47 is between 10 cm and 20 cm, such as 10 cm, 15 cm, 20 cm, etc. The thickness of the base body 47, that is, the distance between the top wall and the bottom wall, is between 10 cm and 20 cm. If the thickness of the inflatable cushion is too large, it will be inconvenient for users to enter and exit the tent, and it will also increase the cost. If the thickness of the inflatable cushion is too small, the distance between the top wall and the bottom wall of the inflatable cushion will be too small, which will easily cause pressure contact against the top wall and the bottom wall, thereby reducing the effect of the gas in the inflatable cushion and resulting in poor experience of users.

There is a sealing part 48 and a positioning part 49 on the base body 47, and the sealing part 48 and the positioning part 49 can be detachably connected with the base body 47 using, for example, hook-and-loop fasteners, zippers or hooks; or the sealing part 48 and the positioning part 49 all are fixedly connectable with the base body 47, such as integral molding, sewing, bonding, etc. In present disclosure, the sealing part 48 and the base body 47 are bonded with glue or hot melt adhesive. The positioning part 49 and the base body 47 are also fixed by bonding. The production process of bonding is simple, which improves the production efficiency and reduces the cost of production. Both the sealing part 48 and the positioning part 49 are located on the same side of the base body 47. Specifically, the sealing part 48 and the positioning part 49 are located on the top wall, and the sealing part 48 and the positioning part 49 are connected to the top wall.

The thickness of the positioning part 49 is between 2 cm and 8 cm, and the height of the sealing part 48 is between 10 cm and 20 cm, which facilitates the connection between the sealing part 48 and the main body 1.

The sealing part 48 and the positioning part 49 are circumferentially closed, that is, the sealing part 48 and the positioning part 49 are polygonal or circular structures connected end to end. A closed structure of the sealing part 48 and the positioning part 49 is stronger than a discontinuous or wholly closed structure, which improves quality of the product.

The sealing part 48 is located outside the positioning part 49, that is, the positioning part 49 is inside the surrounding circle formed by the sealing part 48, and the sealing part 48 can protect the positioning part 49 from the possibility of being scratched and damaged. Of course, for installation or production requirements, the sealing part 48 can be arranged inside the positioning part 49, and the production thereof can be adjusted according to user requirements.

The outer contour of the base body 47 is generally hexagonal, including two opposite first sides 472 and four second sides 473, wherein the two first sides 472 are of equal length, the four second sides 473 are of equal length, two of the four second sides 473 are connected to each other and located on one side of the opposite first sides 472, and the other two second sides 473 are connected to each other and located on the other side of the opposite first sides 472. The first side 472 is shorter than the second side 473, so that users can better distinguish the first side 472 and the second side 473.

The base body 47 also includes a handle part 474 located on the side wall. Specifically, there are four handle parts 474, which are respectively located at the four second sides 473. The handle part 474 facilitate users to move, unfold or store the base 4. The handle parts 474 are located on the longer second side 473, that is, the handle parts 474 are easy to fix and can remind users to store the first side 472 first, and the second side 473 last, which is convenient for finishing after storage. On the mobile base 4, users can simultaneously pull the handle parts 474 on the two connected second sides 473 with both hands, which is convenient for users to exert a force.

The base body 47 includes a first inflation port 471, which is used to inflate the base body 47. Electric inflation or manual inflation can be selected. The positioning part 49 includes a second inflation port 491 for inflating the positioning part 49. The base body 47 and the positioning part 49 are both inflatable structures, which are convenient for the storage and transportation of the base 4 as a whole. At the same time, the inflatable cushion structure is not easy to breed bacteria, which improves the safety. It can be understood that the base body 47 and the positioning part 49 can be two separate parts, which can be inflated respectively; and the base body 47 and the positioning part 49 can also be communicated structures, which could be inflated at the same time via the first inflation port 471, facilitating the inflation.

Further referring to FIG. 28 to FIG. 32, the main body 1 has seven walls, including four side walls 31, two door walls 33 and a top wall 32, that is, the general outline of the side walls 31 is hexagonal. After the main body 1 and the base 4 are installed, the top wall 32 is set opposite to the base 4. Specifically, the top wall 32 is set opposite to the top wall of the base body 47.

The two door walls 33 are arranged oppositely, and the position of the first side 472 of the base 4 is close to or opposite to the door wall 33. That is, the door wall 33 is located above the first side 472 of the base 4 or both are close to each other. The two first sides 472 correspond to the two door walls 33 respectively. The four side walls 31 and the second side 473 of the base 4 are close or opposite in position, that is, the side wall 31 is located above the second side 473 of the base 4 or both are close to each other, and the four second sides 473 respectively correspond to the four side walls 31.

The handle part 474 is located at the second side 473, so that the handle part 474 is far away from the first side 472. When a user enters and exits the main body 1, there are no other parts on the first side 472, which improves the aesthetics of the base and improves user experience. That is, the handle part 474 is located below the side wall 31.

The first inflation port 471 is located in the vicinity of the second side 473, that is, the first inflation port 471 is far away from the first side 472, so that when a user enters and exits the main body 1 through the door wall 33, the first inflation port 471 is less likely to be touched or stepped on, improving the service life of the first inflation port 471. Similarly, the second inflation port 491 is also located away from the first side 472. The first inflation port 471 is located on the side wall of the base 4, or the first inflation port 471 is located on the top wall and outside the main body 1, so that after the installation of the main body 1 and the base 4 is completed, the gas supply operation can still be conveniently performed. In the process of storage, the base 4 can be deflated while the main body 1 is being stored, and the gas discharged from the first inflation port 471 will not rush into the main body 1, reducing the possibility of odor inside the main body 1.

The main body 1 includes a connecting part 11, which is located at the bottom or lower part of the main body 1. The connecting part 11 can be used to connect with the base 4. When the main body 1 is installed on the base 4, the connecting part 11 can be located outside the sealing part 48, that is, the connecting part 11 can form a ring wrapping the sealing part 48 and the positioning part 49, which can not only reduce the exposure of the sealing part 48 and the positioning part 49 of the base 4 by using the main body 1, so as to prolong its life, but also reduce the rainwater flowing into the main body 1 along the joint of the connecting part 11 and the sealing part 48, thereby improving user experience. The main body can also protect the sealing part 48 and the positioning part 49 to reduce the possibility of being scratched. It can be understood that the connecting part 11 can also be installed in another position, that is, the connecting part 11 is located between the sealing part 48 and the positioning part 49. The sealing part 48 is located outside the connecting part 11, and the positioning part 49 is located inside the connecting part 11. At this time, the sealing part 48 can protect the connecting part 11, and when it rains and the rainwater flows from the side wall 31 of the main body 1 to the connecting part 11 at the bottom, the possibility of the rainwater flowing into the main body 1 is effectively reduced since the positioning part 49 and the sealing part 48 are all inside the connecting part 11.

The sealing part 48 is adapted with the connecting part 11, the sealing part 48 and the connecting part 11 are connected in a detachable manner, which is convenient for users to disassemble and assemble separately; they can also be directly fixed and non-detachably connected, so that the main body 1 and the base 4 has a higher connection strength. The positioning part 49 is located inside the main body 1, that is, the positioning part 49 is located inside the connecting part 11. After the positioning part 49 is inflated by the second inflation port 491, the positioning part 49 in a full state can support or position the connecting part 11, so that the connecting part 11 is installed to a suitable position, which is convenient for users to install the main body 1 on the base 4, and supports the connecting part 11 in its original shape, reducing the deformation caused by extrusion, movement or other methods, so that the connecting part 11 and the whole main body 1 maintain the original shape, which improves user experience. The positioning part 49 in a full state has a certain height, which reduces the entry of external liquid into the inner area formed by the positioning part 49 and improves user experience.

The main body 1 is detachably connected to the base 4 through the connecting part 11. Specifically, the connecting part 11 is connected to the sealing part 48. The connecting part 11 and the sealing part 48 can be detachably connected to realize the detachable connection between the main body 1 and the base 4, facilitating users storing and tidying the main body 1 and the base 4. The connecting part 11 and the sealing part 48 can also be fixedly connected, for example, by sewing, etc. The sealing part 48 and the base body 47 are detachably connected to realize detachable connection of the main body 1 and the base 4.

The detachable connection methods in this embodiment include, but are not limited to, hook-and-loop fasteners, snap fasteners, buttons, buckles, magnetic attractors, zippers or others. For example, the connecting part 11 is provided with a sticking area 842 of the male sticker of the hook-and-loop fastener, and the sealing part 48 is provided with a sticking area 842 of the female sticker of the hook-and-loop fastener. The sticking area 842 of the male sticker of the hook-and-loop fastener is located at the upper end of the sealing part 48, which improves the waterproof ability and the convenience of user installation. The two sticking areas 842 correspond to each other, that is, the heights are consistent, so that the connecting part 11 and the sealing part 48 are connected by the hook-and-loop fastener, and the hook-and-loop fastener on the connecting part 11 and the sealing part 48 is arranged circumferentially along the connecting part 11 and the sealing part 48, so that the connecting part 11 and the sealing part 48 are tightly sealed in its circumference, bringing about waterproof effect as well as a certain insect-proof effect, and improving users' outdoor experience.

When the connecting part 11 and the sealing part 48 are connected, the lower part of the connecting part 11 abuts against the base 4, and the base 4 supports the weight of the main body 1, which improves the stability of the main body 1 during installation. At the same time, the main body 1 directly installs the two door walls 33 correspondingly to the two first sides 472, and the four side walls 31 correspondingly to the four second sides 473. The main body 1 is sleeved to the positioning part 49, so that the main body 1 is more stable and upright during pre-installation, which reduces the need of subsequent finishing of the main body 1 through the installation using the hook-and-loop fastener and buckles, etc., thereby improving user's installation experience.

One of the connecting part 11 of the side wall 31 and the base body 47 has a second fixing piece 36, and the other has a first fixing piece 475, and the second fixing piece 36 and the first fixing piece 475 are adapted to each other. The second fixing piece 36 of this embodiment is located on the connecting part 11, which can be a cloth ring, or a ring made of plastic, or a ring made of metal directly fixed to the main body 1, or a combination of the cloth ring and the metal ring. The first fixing piece 475 is fixed on the base body 47 and is located in vicinity of the second side 473. One end of the first fixing piece 475 is fixed on the base body 47 by cloth strips, plastic or metal. The second fixing piece 36 is adapted with the first fixing piece 475, and the two are detachably connected, which improves the stability of the connection between the main body 1 and the base 4, thereby improving the overall wind resistance.

The second fixing piece 36 or the first fixing piece 475 are of stretchable cloth belt or elastic material, and the stretchable cloth bag can be stretched through a "(D"-shaped button, which provides users a certain stretching margin and reduces the possibility of installation failure due to an exceeding distance caused by installation or positioning deviation, thereby improving user's experience. It can be understood that the second fixing piece 36 located at the lower part of the connecting part 11 can be directly fixed to the ground through pegs, and when the main body 1 is fixed, the base 4 can be directly fixed, thereby improving the stability of the entire tent.

The edge of the outer tent 102 can be provided with metal rings 35, which can be connected to the first fixing piece 475 on the base 4 to fix the outer tent 102 on the base 4, or the second fixing piece 36 can be set on the metal ring 35, which can be a cloth strip ring or an elastic ring. The metal ring 35 and the first fixing piece 475 are connected through the second fixing piece 36 made of cloth. A certain margin is provided at the joint to facilitate installation and operation of users. It can be understood that the outer tent 102 can be connected to the base 4 through hook-and-loop fasteners, snap fasteners, buttons, magnetic attractors, zippers or other connection methods.

In some embodiments, the base 4 is provided with a cloth fixing ring located on or near the second side 473 of the base body 47, specifically on the side wall of the second side 473. The cloth fixing ring can be an elastic structure, which is convenient for users to stretch, and reduces the problem of dislocation and difficult installation caused by repeated use. Of course, the cloth fixing ring may also be of a non-elastic structure, which is more secure when fixed and reduces the possibility of shaking. The cloth fixing ring can be disassembled and installed on the base 4 as an accessory, and the user can choose an accessory upon the demand, which meets diverse needs of users. The cloth fixing ring is connected through the peg structure to fix the overall structure of the base.

Although the embodiments of the present disclosure have been shown and described, those skilled in the art can understand that various changes, modifications, substitutions and variations can be made to these embodiments without departing from the principle and spirit of the present disclosure. The scope of the present disclosure is defined by the appended claims and their equivalents.

The invention claimed is:

1. A multi-form tent, comprising a main body and a base detachably connected to the main body, wherein the main body comprises an inner tent and an outer tent, the outer tent being at least partly located above the inner tent, the inner tent supporting the middle of the outer tent, the inner tent and the outer tent being detachably connected, wherein there are at least two forms of mutual connection between the outer tent and the inner tent;

the base comprises a base body and a sealing part, the sealing part is fixedly connected to the base body, the inner tent is provided with a connecting part at the bottom, the connecting part is detachably connected to the sealing part, both the connecting part and the sealing part are located above the base body, the connecting part and the sealing part are connected by hook-and-loop fasteners, snap fasteners, buttons, buckles, magnetic attractors or zippers; and both the connecting part and the sealing part are provided with sticking areas, a height of the sticking area of the connecting part is consistent with that of the sticking area of the sealing part, the sticking area of the sealing part is located at an upper end of the sealing part, the base body includes a positioning part located on an inner side of the sealing part, and the positioning part and the sealing part are located on an inner side of the connecting part.

2. The multi-form tent according to claim 1, wherein the inner tent includes side walls and a top wall, and a joint between the side walls and the top wall is connected with the outer tent, the top wall is located completely under the outer tent.

3. The multi-form tent according to claim 2, wherein said side walls include window side walls and at least one door wall, a height of an edge of said outer tent located in front of said window side walls being lower than that of an edge of the outer tent in front of the at least one door wall.

4. The multi-form tent according to claim 3, wherein there are at least two tents, and the outer tents of adjacent tents are detachably connected.

5. The multi-form tent according to claim 4, wherein the adjacent outer tents are connected by one of buckles, magnetic attractors, snap fasteners and hook-and-loop fasteners.

6. The multi-form tent according to claim 3, wherein the base further comprises at least one first side and second sides, the at least one door wall corresponding to the at least one first side, and the side walls corresponding to the second sides, the side walls are each provided with a second fixing piece, the second sides are each provided with a first fixing piece, and the second fixing piece being arranged vertically opposite to the first fixing piece.

7. The multi-form tent according to claim 2, wherein the outer tent has a wrapped state, wherein the outer tent completely wraps the top wall and the outer tent at least partially wraps the side walls, and the outer tent includes an outer tent opening, the side walls includes a door wall, and the outer tent opening is arranged opposite to the door wall.

* * * * *